United States Patent [19]

Kristofek

[11] 4,293,895

[45] Oct. 6, 1981

[54] MOUNTING ARRANGEMENT FOR RECESSED LIGHT FIXTURE HOUSING

[75] Inventor: Paul J. Kristofek, Hickory Hills, Ill.

[73] Assignee: McGraw-Edison Company, Rolling Meadows, Ill.

[21] Appl. No.: 68,934

[22] Filed: Aug. 23, 1979

[51] Int. Cl.[3] ..... F21V 33/00

[52] U.S. Cl. ..... 362/147; 362/364; 362/365; 362/404

[58] Field of Search ..... 362/147, 404, 364, 365

[56] References Cited

U.S. PATENT DOCUMENTS 4,175,281 11/1979 Lonseth ..... 362/147

*Primary Examiner*—Stephen J. Lechert, Jr.

*Attorney, Agent, or Firm*—Jon C. Gealow; Ronald J. LaPorte; Charles W. MacKinnon

[57] ABSTRACT

An arrangement for the recessed mounting of an enclosed light fixture housing having an open end with a flange formed about the periphery thereof in an aperture defined in a planar member, such as a ceiling, includes a slotted aperture defined in the side wall of the housing with ratchet teeth formed therealong adjacent the slotted aperture, a support frame mounted behind the ceiling and including an aperture dimensioned similarily to and aligned with the aperture in the ceiling and a resilient mounting clip attached to the support frame and extending into the aperture. The free end of the mounting clip is dimensioned for receipt in the slotted aperture of the housing side wall upon insertion of the housing into the aligned ceiling and support frame apertures. Shoulder portions adjacent the free end of the clip engage the ratchet teeth to removably lock the housing in position in the ceiling.

6 Claims, 6 Drawing Figures

MOUNTING ARRANGEMENT FOR RECESSED LIGHT FIXTURE HOUSING

BACKGROUND OF THE INVENTION

This invention relates generally to an arrangement for the recessed mounting of an enclosed light fixture housing in an aperture in a planar support member, such as, for example, a ceiling and more particularly to such an arrangement designed specifically for mounting an enclosed light fixture housing in such a support member using a plaster frame.

Conventionally, when recessed light fixtures are mounted in newly constructed ceilings of houses, office buildings or the like structures, what is commonly known as a "plaster frame" is employed to support the fixture housing. A plaster frame is generally a metal or the like member mounted between the joists of the structure supporting a ceiling or wall. The plaster frame generally includes an aperture defined therein surrounded by a depending flange which is received in a similarly dimensioned aperture defined in the support member.

Various arrangements for mounting light fixtures in ceilings utilizing plaster frames are known in the prior art. An example of such a prior art arrangement is illustrated in U.S. Pat. No. 3,130,949. This patent discloses a specially designed plaster frame for mounting on a support member and includes a variety of bosses and the like for receiving straps, etc., with which specially designed light fixture housings can be mounted in recessed fashion in the support member.

The plaster frame and associated elements shown in the patent are rather complex in design and construction, and appear to be relatively costly to fabricate.

Another, U.S. Pat. No. 3,518,420, illustrates a recessed light fixture which includes an arrangement for the attachment of a trim ring therefor to the plaster frame supporting the fixture. The trim ring is employed to mask or cover the edge of the light fixture housing and ceiling exposed upon mounting the light fixture housing in recessed fashion in the ceiling.

The particular plaster frame described in the patent includes tabs mounted thereabout which engage serrations on arms extending outwardly from the trim ring, which arms pass through apertures in the plaster frame adjacent the tabs to secure the trim ring on the support member. The trim ring is removable from its mounted position by the application of sufficient downward force to break the engagement of the serrations and tabs.

While the last-described arrangement appears to function adequately to support the facing or trim ring of the fixture, it does not contribute support to the fixture itself, which requires additional components for mounting the fixture housing to the plaster frame.

SUMMARY OF THE INVENTION

Accordingly, it is the primary object of the present invention to provide a new and improved arrangement for mounting an enclosed light fixture housing in a planar support member, such as, for example, a ceiling or wall, in recessed fashion with respect thereto using a plaster frame or the like support member.

It is another object of the present invention to provide a mounting arrangement of the above-described type wherein the arrangement includes a minimum number of components which are easily assembled and relatively inexpensive to fabricate.

Briefly, a preferred embodiment of an arrangement according to the invention for the recessed mounting of an enclosed light fixture housing having an open end surrounded by an outwardly extending flange, in a planar support member such as a ceiling or the like, includes a plaster frame mountable along the inner surface of the support member and defining an aperture surrounded by a depending lip which is dimensioned for receipt in a similarly dimensioned aperture in the support member through which the fixture housing is inserted.

At least one resilient mounting clip is coupled to the plaster frame and extends therefrom inwardly toward the aperture defined therein. The clip includes a cam surface at the free end thereof on opposite sides of which are defined shoulder portions.

The enclosed light fixture housing is dimensioned for receipt in the aperture of the plaster frame and includes an elongated slotted aperture defined in the side wall of the housing, the slotted aperture extending perpendicular to the plane of the support member. Ratchet teeth are formed on the housing side wall along at least one edge of the slotted aperture.

Upon insertion of the fixture housing into the aperture of the plaster frame, the cam surface of the mounting clip engages the side wall of the housing. After the housing is inserted partially into the plaster frame, the free end of the clip is received in the slotted aperture in the housing side wall. The clip, being resilient, snaps into the slotted aperture with the shoulder portions engaging the ratchet teeth. Thereafter, the housing is further inserted until the flange about the open end thereof engages the outer surface of the support member, covering the edge of the plaster frame and ceiling. The shoulder portions of the resilient clip remain in engagement with the ratchet teeth to removably secure the housing in recessed fashion on the support member.

To remove the housing from the aperture the free end of the mounting clip extending through the housing side wall is pushed outwardly of the slotted aperture to disengage the shoulder portions and ratchet teeth, thereby releasing the housing for withdrawal from the plaster frame and support member.

and

Figure 4:
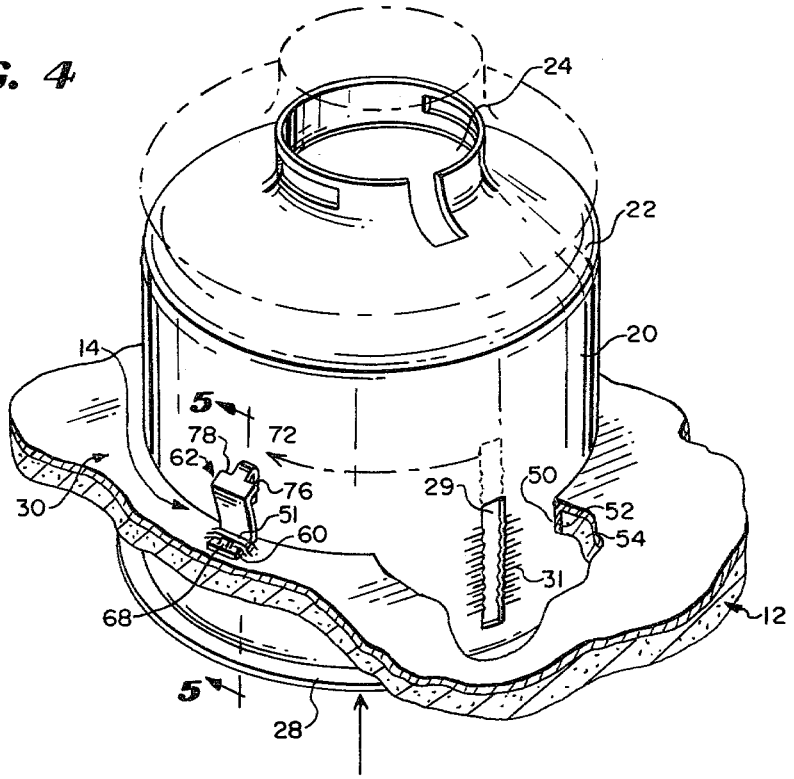
FIG. 4 is a fragmentary perspective view of the enclosed light fixture housing and mounting arrangement of FIG. 1, illustrating the function of the mounting arrangement.
Figure 5:
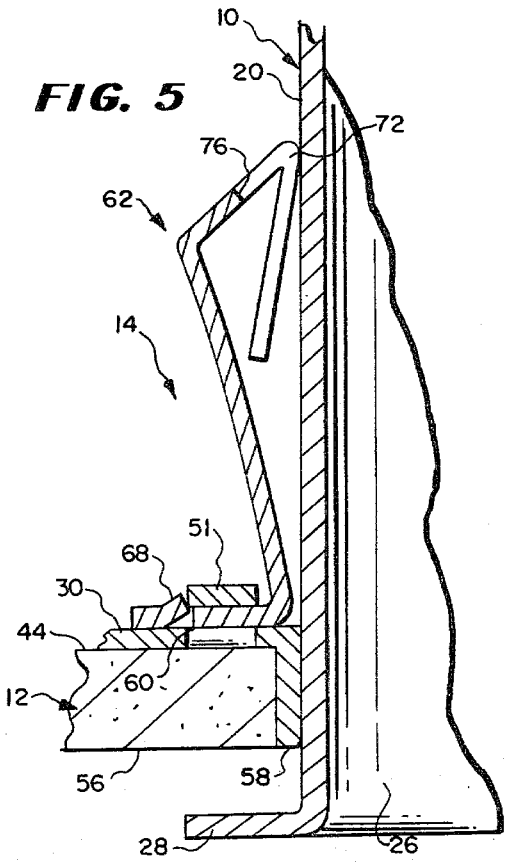
Figure 6:
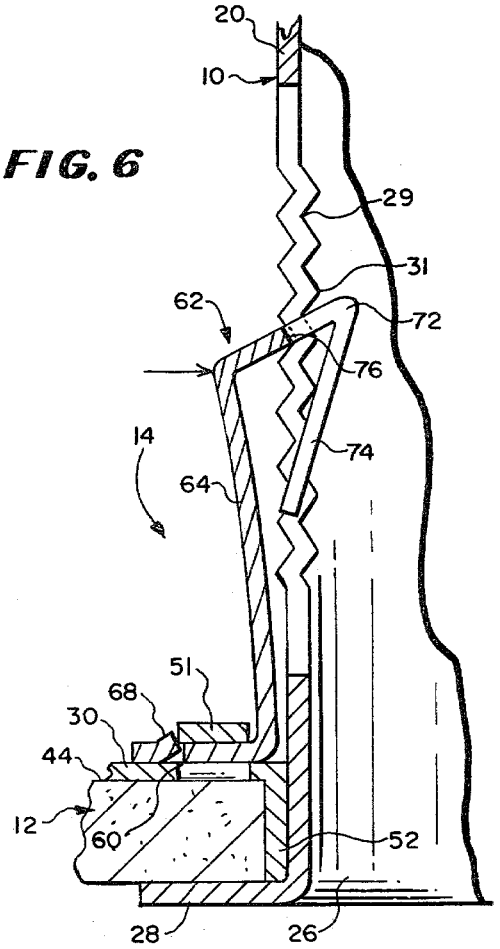

FIGS. 5 and 6 are enlarged side sectional views of the light fixture housing and mounting arrangement of FIG. 4 taken along the line of 5—5, illustrating the relation of the clip and housing before and after, respectively, the clip has been received in the slotted aperture defined in the housing wall.

DETAILED DESCRIPTION OF THE DRAWINGS

Figure 1:
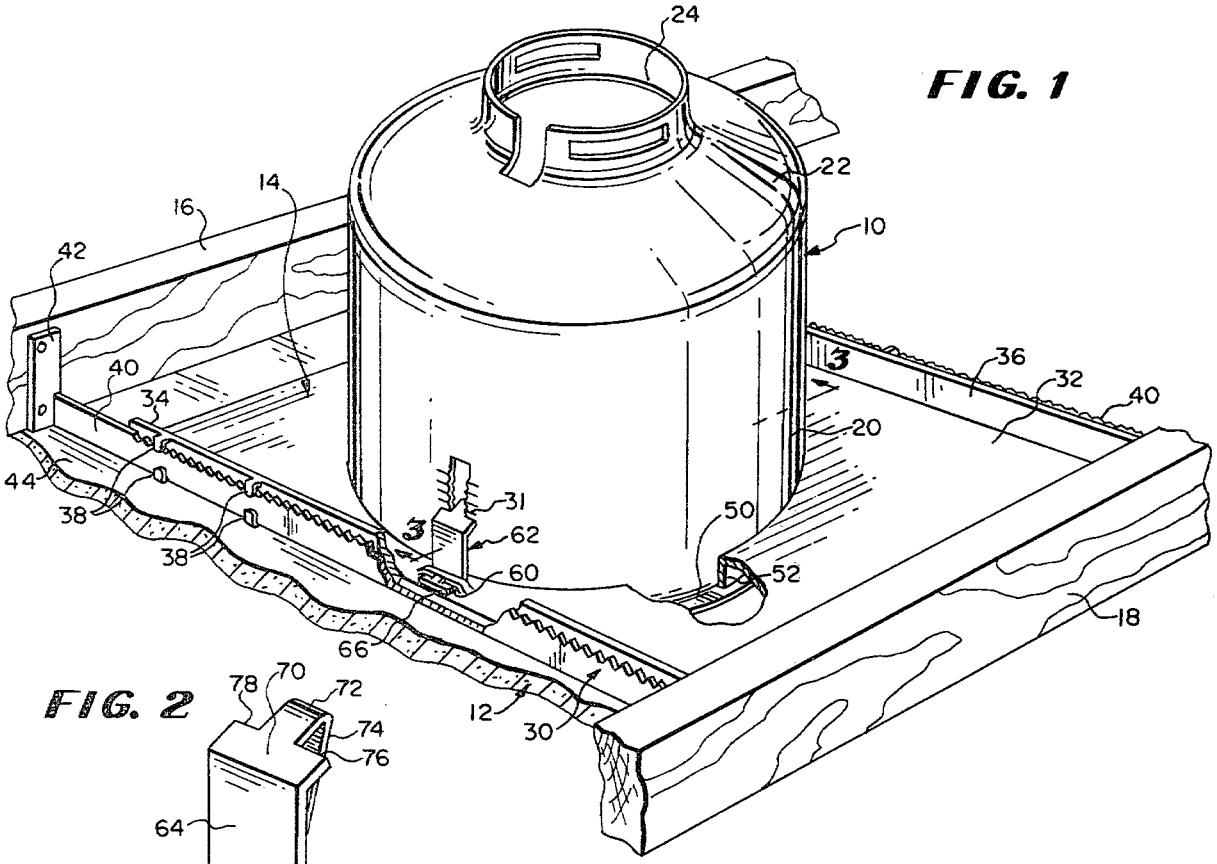
FIG. 1 is a perspective view of an enclosed light fixture housing mounted in recessed fashion on a support member, such as a ceiling, by means of a mounting arrangement including a plaster frame according to the invention.
Figure 3:
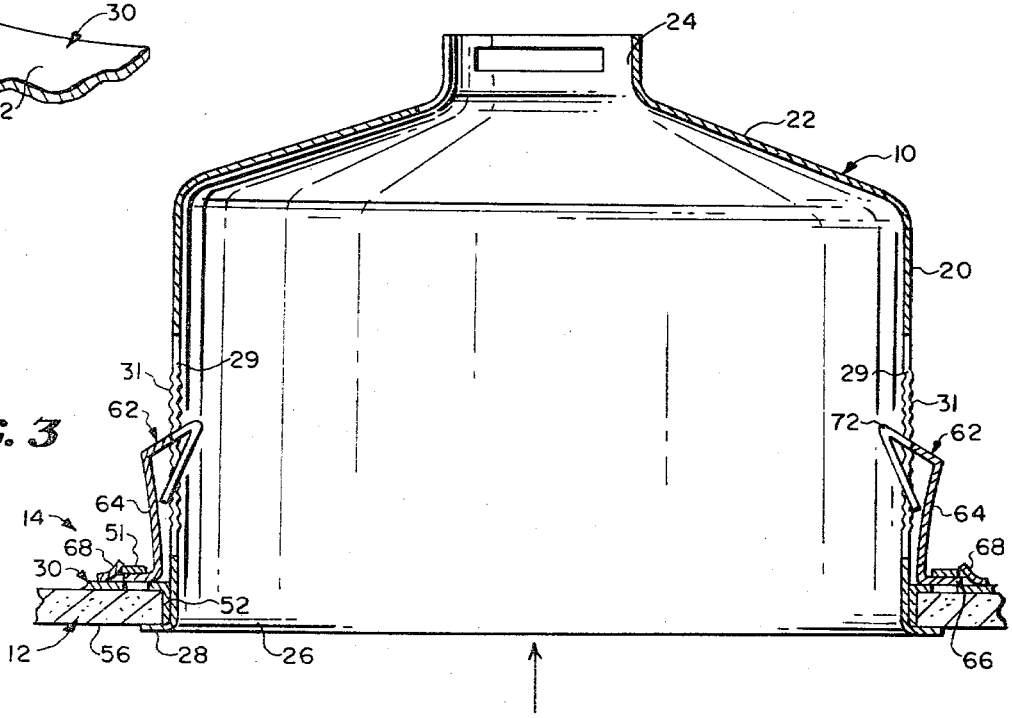
FIG. 3 is a side sectional view of the enclosed light fixture housing and mounting arrangement of FIG. 1, taken along the line 3—3 thereof.

Referring now to the drawings in greater detail wherein like numerals have been employed throughout the various views to designate similar components, there is illustrated in FIGS. 1 and 3, an enclosed light fixture housing, designated generally by the numeral 10, mounted in recessed fashion in planar support member 12, herein taking the form of a ceiling, by means of the mounting arrangement numbered 14, according to the invention.

As is seen in FIG. 1, the member 12 is itself supported from structural members or joists 16, 18, customarily employed in building construction. Member 12, herein shown to be a sheet of preformed plaster or wall board, is attached with suitable fasteners (not shown) to joists 16, 18.

The enclosed light fixture housing 10 is illustrated as being cylindrical in shape, but may take other forms and still fall within the scope of the present invention. The housing 10 includes a cylindrical side wall 20 joined integrally by a top wall 22, the latter of which defines an opening 24 into which a lamp socket (not shown) is received to close off the top of the housing. Along the perimeter of the open end 26 of the housing is formed a radially outwardly extending flange 28. A slotted aperture 29 is defined in side wall 20 of housing 10. The aperture extends substantially parallel to the longitudinal axis of the housing. Locking means comprising ratchet-like teeth 31 are formed on the housing wall along the edges of the aperture. As will be described hereinafter, the slotted aperture and ratchet teeth cooperate with a mounting clip to be described, for locking the light fixture housing in a mounted condition in the planar support member 12.

To support the housing in ceiling 12, there is provided a plaster frame designated by the numeral 30. Plaster frame 30 is for the most part of conventional construction including a planar wall 32 dimensioned to extend parallel to the inner surface of the ceiling 12 between the support joists 16, 18. Side walls 34, 36 extend perpendicularly upwardly from the planar wall 32 and each includes fingers such as 38 spaced therealong to define a channel for receiving support arms such as 40 (FIG. 1). The arms 40 are adjustable in length for extension between joists 16, 18. At the ends of the arms 40 are provided mounting plates 42, which, with suitable fasteners such as nails or screws, are attachable to respective joists for supporting the plaster frame along the inner surface 44 of the support member 12.

The wall 32 of the plaster frame defines an aperture 50 dimensioned similarly to the light fixture housing. In the example shown in the drawings, aperture 50 is circular in shape to accommodate cylindrical housing 10. A rim 52 surrounding aperture 50, depends from the planar wall 32 of the plaster frame. A slightly larger aperture 54 is defined in member 12 for receipt of depending rim 52 of the plaster frame. The height of rim 52 is similar to the thickness of the support member 12 so that the outer surface 56 of support member 12 and the free edge 58 of depending rim 52 are substantially flush. The latter is not absolutely necessary as the rim may be shorter than the thickness of the support member 12, however, for appearance purposes, it is desirable to provide components dimensioned as described heretofore.

The plaster frame 30 according to the invention differs slightly from a conventional plaster frame in that it includes at least one and preferably two slots 60 defined in the wall 32, along the perimeter of aperture 50. The slots are formed by the raised strap portions 51 cut from the planar wall 32 of the frame. When two slots are provided, they are located diametrically opposite each other in the case of the circular aperture or on opposite sides of a polygonally shaped aperture, if such is provided. The purpose of the slots as will be seen, is to permit attachment of mounting clips such as 62, to be described in greater detail hereafter, on the plaster frame, which clips are used for removably securing the light fixture housing 10 in a recessed position in the member 12.

Figure 2:
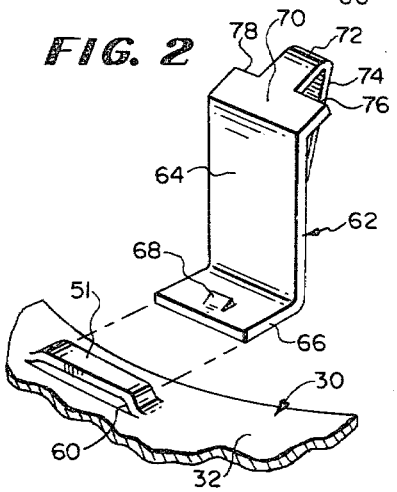
FIG. 2 is an enlarged, perspective view of a mounting clip and portion of the plaster frame included in the mounting arrangement of FIG. 1.

Included in the mounting arrangement 14 are clips 62 mentioned heretofore, and illustrated in greatest detail in FIG. 2 of the drawings. Mounting clip 62, which is preferably constructed of a single piece of resilient metal or other suitable material, includes a body portion 64 from which a tab 66 extends at one end thereof, the tab 66 is at substantially right angles with respect to body portion 64 and includes a tang 68 defined thereon, the purpose of which will be discussed hereinafter.

At the opposite end of body portion 64, there is provided an angularly bent end portion 70 defining a cam surface 72 formed by bending over the free end 74 of the mounting clip. Free end 74 of the clip is narrowed with respect to body portion 64 to define shoulders 76, 78, on opposite sides of cam surface 72.

As mentioned heretofore, at least two mounting clips 62 which cooperate with slotted apertures 29 defined in the sidewall of the light fixture housing are employed to secure the housing 10 on member 12. Since both the clips and apertures are identical, reference to only one clip and aperture will be made herein when describing the mounting operation of the light fixture housing.

To make use of the light fixture mounting arrangement according to the invention, plaster frame 30 is mounted behind planar support member, such as ceiling 12, along surface 44 thereof in the manner described heretofore. Clips 62 are thereafter attached to the plaster frame by inserting tabs 66 thereof into respective slots 60 provided on the plaster frame about aperture 50. Tab 66 is inserted so that the tang 68 included thereon passes strap 51 and catches thereon to secure the clip on the plaster frame. End portion 70 of the mounting clip 62 including cam surface 72, extends inwardly toward aperture 50 in which the light fixture housing is to be received.

In the case of the cylindrical light fixture housing 10 illustrated in the drawings, the latter is inserted into the aperture 50 in the support member 12, top wall 22 first, without regard to the alignment of tab 60 with slotted aperture 29. Upon insertion of the housing 10, cam surface 72 of clip 62 engages the flat side wall of the fixture housing and, being resilient, the clip flexes outwardly away from the side wall of the housing. Once the fixture housing is inserted almost fully into aperture 50, the housing is rotated until end 70 of the mounting clip enters slotted aperture 29. At that time, shoulders 76, 78 of the clip engage ratchet teeth 31 formed along the edges of slotted aperture 29. Additional force is applied to the housing 10 to insert it fully against the force now provided by engagement of shoulders 76, 78 and ratchet teeth 31, until flange 28 of the housing rests against surface 56 of support member 12.

The engagement of shoulder 76, 78 of the clip and ratchet teeth 31, serve to removably lock housing 10 in aperture 50 on plaster frame 30. To remove the housing, one need only to reach into the housing, press clip ends 70 outwardly to disengage shoulders 76, 78 and ratchet teeth 31, and thereafter pull downwardly on the housing.

In the case wherein the aperture in support member 12 is polygonal and the shape of the light fixture housing is similar thereto, end 70 of clip 62 enters slotted aperture 29 shortly after insertion of the housing into the aperture thereby to secure the fixture housing on the plaster frame. In the case of the polygonally shaped fixture housing, however, because of the initial engagement of the shoulders 76, 78 and ratchet teeth 31, it may be advisable to alter the position of the slotted aperture 29, placing it nearer top wall 22 of the housing so that shoulders 76, 78 and ratchet teeth 31 are engaged only slightly prior to the full insertion of the housing into the aperture.

While a preferred embodiment of the mounting clip 62 has been described as including a tab 66 receivable beneath strap 51 forming slot 60 on the plaster frame 30 to secure the mounting clip on the frame, it would also be possible to provide other means for removably securing the clip to the plaster frame or to permanently secure the clip to the plaster frame during manufacture thereof. In the latter case, however, if a clip should break free of the frame in use, replacement of the clip would become more difficult, expensive and time-consuming.

While a particular embodiment of the invention has been shown and described, it should be understood that the invention is not limited thereto since many modifications may be made. It is therefore contemplated to cover by the present application any and all such modifications as fall within the true spirit and scope of the appended claims.

I claim:

1. An arrangement for mounting an enclosed light fixture housing having an open end with a flange formed about the periphery thereof, in an aperture defined in a planar member having first and second surfaces, said housing being receivable in said aperture with said flange engaging said second surface, said arrangement including in combination:

a side wall of said light fixture housing defining a slotted aperture, locking means provided on said side wall adjacent said slotted aperture, said locking means including ratchet teeth formed along said housing wall adjacent said slotted aperture, support frame means mounted along the first surface of said planar member and defining an aperture dimensioned for receipt of said light fixture housing and being aligned with the aperture defined in said planar member and resilient mounting clip means extending outwardly from said support frame means toward said aperture, the free end of said mounting clip means being receivable in said slotted aperture in said housing side wall upon insertion of said housing into said aligned apertures of said planar member and support frame means, said mounting clip means further including means cooperating with said ratchet teeth for removably securing said housing on said support frame means.

2. A mounting arrangement as claimed in claim 1 wherein said cooperating means of said mounting clip means includes a shoulder portion defined adjacent the free end of said mounting clip for locking engagement with said ratchet teeth, thereby to secure said light fixture housing on said support frame means.

3. A mounting arrangement as claimed in claim 2 wherein the free end of said mounting clip means includes a cam portion for engaging the side wall of said light fixture housing prior to receipt of said free end of said mounting clip means in said slotted aperture, thereby permitting easy insertion of said housing into said aperture in said planar member.

4. A mounting arrangement as claimed in claim 3 wherein said fixture housing is cylindrical, wherein said aligned apertures in said planar member and said support frame, respectively, are circular and wherein upon insertion of said fixture housing into said apertures, said cam portion engages said housing side wall and said free end of said mounting clip means is received in said slotted aperture upon rotating said fixture housing in said aligned apertures, thereby to align said slotted aperture and mounting clip means.

5. A mounting arrangement as claimed in claim 1 wherein in said mounting clip means includes first securing means and wherein said support frame means includes second securing means engageable with said first securing means, for removably attaching said mounting clip means to said support frame means.

6. A mounting arrangement as claimed in claim 5 wherein said first securing means includes a raised strap formed on said support frame means, defining a slot, and wherein said second securing means includes a tab extending from said mounting clip means, dimensioned for receipt in said slot, said tab further including a tang for engaging said strap upon predetermined insertion of said tab into said slot, thereby preventing easy separation of said mounting clip means and said support frame means.

* * * * *